United States Patent [19]

Murray et al.

[11] Patent Number: 4,880,559

[45] Date of Patent: Nov. 14, 1989

[54] CERIC ACID DECONTAMINATION OF NUCLEAR REACTORS

[75] Inventors: Alexander P. Murray, Murrysville Boro; Clifton G. Slater, Wilkinsburg; Robert W. White, New Kensington, all of Pa.

[73] Assignee: Westinghouse Electric Corp., Pittsburgh, Pa.

[21] Appl. No.: 208,825

[22] Filed: Jun. 15, 1988

Related U.S. Application Data

[60] Continuation of Ser. No. 930,196, Nov. 13, 1986, abandoned, which is a division of Ser. No. 802,132, Nov. 26, 1985, Pat. No. 4,657,596, which is a continuation-in-part of Ser. No. 615,018, May 29, 1984, abandoned.

[51] Int. Cl.[4] ..... G21F 9/00; C23G 1/02

[52] U.S. Cl. ..... 252/186.21; 252/186.1; 252/187.1; 252/187.31; 252/87; 376/310; 134/3

[58] Field of Search ..... 376/308–310; 252/87, 186.1, 186.21, 187.1, 187.31, 626; 134/3

[56] References Cited

U.S. PATENT DOCUMENTS

| | | | |
|---|---|---|---|
| 4,162,229 | 7/1979 | Loewenschuss | 252/626 |
| 4,512,921 | 4/1985 | Anstine et al. | 134/3 |
| 4,685,971 | 8/1987 | Murray et al. | 252/626 |

FOREIGN PATENT DOCUMENTS

| | | | |
|---|---|---|---|
| 0134664 | 3/1985 | European Pat. Off. | 252/626 |

OTHER PUBLICATIONS

BNWL-805, 8/68, Lerch.

*Primary Examiner*—Harvey E. Behrend

*Attorney, Agent, or Firm*—Joyce L. Morrison; R. D. Fuerle

[57] ABSTRACT

Disclosed is a method of decontaminating the metal surfaces in the cooling system of a nuclear reactor by contacting the metal surfaces with an aqueous solution containing about 0.5 to about 3% of a ceric acid which can be tetrasulfato ceric acid, hexasulfamato ceric acid, hexaperchlorato ceric acid, or mixtures thereof, and about 1 to about 5% of an inorganic acid that forms a complex with the ceric acid.

The cerium III in the aqueous solution can be oxidized to cerium IV to increase the life and effectiveness of the solution. After oxidation, the aqueous solution can be passed through a hydrogen form cation exchange column to remove metal ions. If the aqueous solution contains uranyl or plutonyl ions these can be recovered by extraction for use in making fuel.

Also disclosed is a decontaminating solution of water containing about 0.5 to about 3% of a ceric acid which can be tetrasulfato ceric acid, hexasulfamato ceric acid, hexaperchlorato ceric acid, or mixtures thereof, and about 1 to about 5% of an inorganic acid that forms a complex with the ceric acid.

3 Claims, No Drawings

CERIC ACID DECONTAMINATION OF NUCLEAR REACTORS

CROSS REFERENCES TO RELATED APPLICATIONS

This application is a continuation of application Ser. No. 06/930,196 filed Nov. 13, 1986 abandoned which is a division of application Ser. No. 802,132, now U.S. Pat. No. 4,657,596, filed Nov. 26, 1985, which is a continuation-in-part of copending application, Ser. No. 615,018, filed May 29, 1984, and now abandoned.

This application is related to application Ser. No. 513,134, filed July 12, 1983, by A. P. Murray, L. F. Becker, Jr., and M. C. Skriba, titled "Improved Ozone Oxidation of Deposits and Cooling Systems of Nuclear Reactors," abandoned in favor of a continuation, Ser. No. 655,319, filed Sept. 27, 1984 now U.S. Pat. No. 4,685,971.

This application is related to application Ser. No. 501,980, filed June 7, 1983, by A. P. Murray, S. L. Weisberg, and L. F. Becker, Jr., titled "Decontamination of Metal Surfaces in Nuclear Power Reactors", now U.S. Pat. No. 4,587,043.

This application is related to application Ser. No. 513,567, filed July 14, 1983, by S. L. Weisberg, A. P. Murray, and L. F. Becker, Jr., titled "Iron Removal from EDTA Solution."

BACKGROUND OF THE INVENTION

Deposits which contain radioactive elements are often formed in the cooling systems of nuclear reactors. In order to safely maintain and repair the cooling system, it is necessary to remove these radioactive deposits. This can be accomplished, for example, by using an oxidizing solution of an alkali permanganate followed by a decontamination solution of oxalic acid, citric acid, and ethylenediamine tetraacetic acid (EDTA). These solutions solubilize the radioactive metal ions and the other ions in the deposit. The solutions are circulated between the cooling system and ion exchange resins which then remove the ions from the solution.

While many effective decontamination and oxidizing solutions have been found, there is always a need for improved solutions which remove the deposits more readily, are less expensive, or create less waste volume (e.g., spent ion exchange resins). Also, because reactor downtime for removing the deposits is extremely expensive, solutions which can clean the cooling systems more rapidly can save large amounts of money.

Another problem in the nuclear industry is the disposal of steam generators at the end of their useful life. Because the steam generators are highly radioactive, it is necessary to construct an expensive containment building around them to prevent the escape of radiation. Decontamination solutions have not been effective in reducing the radioactivity of these generators to the level required to eliminate the need for a containment building.

Still another problem in the nuclear industry occurs in the mining, treatment/reprocessing, and fabrication of nuclear fuel. Not only does equipment become radioactively contaminated, but the contaminates include uranium and plutonium, which could be used in making fuel if they could be readily and inexpensively recovered from the contaminated equipment.

SUMMARY OF THE INVENTION

We have discovered that a solution of a complex of a ceric acid and an inorganic acid at a certain particular critical concentration range is extremely effective in removing deposits from the cooling systems of nuclear reactors. The solution is so effective, in fact, that it alone removes at least 97% of the radioactivity in the cooling systems, which eliminates the need to use separate oxidizing and decontaminating solutions. We have also found that the solution can remove radioactivity from the deposits of spent steam generators to such a great extent that it is no longer necessary to store the spent generators in specially constructed radiation containment buildings; instead, the spent generators can be safely stored outside with their openings welded shut.

We have also discovered that the ceric acid solution can be continuously rejuvenated by oxidizing the cerium as it circulates. In addition, we have found that the radioactivity of the circulating solution can be reduced by circulating it through a hydrogen form cationic exchange column, which removes radioactive metal cations, such as cobalt. This enables the solution to oxidize and remove a much greater quantity of radioactive deposits than it otherwise would. It also reduces the quantity of radioactive waste that must be disposed of.

In addition, we have found that any uranium or plutonium that is present can be recovered by extraction from the ceric acid solution. In this way, small amounts of uranium or plutonium, which would otherwise not only be lost, but would require disposal as a transuranic (TRU) radioactive waste, can now be recovered and used to make nuclear fuel.

RELEVANT ART

U.S. Pat. No. 4,162,229 discloses the use of cerium (IV) salts in decontaminating the metal surfaces of nuclear reactors. An acid such as sulfuric or nitric acid can be present.

DESCRIPTION OF THE INVENTION

The principles of this invention can be applied to the cooling systems of any nuclear reactor, including pressurized water reactors, boiling water reactors, and gas-cooled nuclear reactors. If the entire rector is to be decontaminated, the reactor is first shut down, which means reducing the temperature of the coolant in the reactor to 70° to 200° F. A ceric acid and an inorganic acid are then added directly to the aqueous coolant. If a portion of the cooling system, such as the steam generator, or other radioactively contaminated equipment, such as from a fuel plant facility, is to be decontaminated, equipment is drained and an aqueous solution is made up which is then circulated through it.

The ceric acid solution of this invention is an aqueous solution of one or more of three ceric acids and an inorganic acid that complexes with the ceric acid. The ceric acid used in this solution may be tetrasulfato ceric acid ($H_4Ce(SO_4)_4$, commonly called "ceric sulphate"), hexasulfamato ceric acid ($H_2Ce(SO_3NH_2)_6$, commonly called "ceric sulfamate"), hexaperchlorato ceric acid ($H_2Ce(ClO_4)_6$, commonly called "ceric perchlorate"), or a mixture thereof. Of the three ceric acids, the tetra sulfato ceric acid is preferred as it is less corrosive. Use of the hexaperchlorato ceric acid is limited to the disposal of spent cooling system equipment due to the presence of chlorine in the acid. Subsequently, this can produce chloride which can cause stress corrosion cracking of stainless steels.

Any inorganic acid or mixture of inorganic acids that will form a complex with the ceric acid in the solution may be used. The acid must be inorganic because the ceric acid will oxidize organic acids, wasting the ceric acid and adding to the quantity of waste products that must be handled. Inorganic acids that do not form a complex with the ceric acid are not suitable because the uncomplexed compounds are not very reactive. Preferably, the inorganic acids used should correspond to the ceric acids that are in the solution. For example, sulfuric acid would be used if the ceric acid were tetrasulfato ceric acid, sulfamic acid would be used if the ceric acid were hexasulfamato ceric acid, and perchloric acid would be used if the ceric acid were hexaperchlorato ceric acid. This results in a more readily formed complex and means that fewer different ions must be monitored and dealt with in the waste disposal of the solution. While use of the corresponding acids is preferred, other inorganic acids that form complexes with the ceric acid, such as nitric acid, can also be used.

We have found that a complex does not form unless a minimum amount of the inorganic acid and the ceric acid are present. Thus, the concentrations of the ceric acid and the inorganic acid in the solution are to be regarded as critical to the effectiveness of the solutions in decontaminating metal surfaces. The concentration of the ceric acid in the solution should be about 0.5 to about 3% (all percentages herein are by weight based on the solution weight). Less than 0.5% of the ceric acid has virtually no effect on decontamination and more than about 3% of the ceric acid is unnecessary and adds to the waste volume without producing additional decontamination. Also, more will require that more inorganic acid be present, which will result in more corrosion of the metal surfaces. The concentration of the inorganic acid in the solution is about 1 to about 5%. If less than about 1% is used, there is virtually no effect in decontaminating the metal surfaces, even when the concentration of the ceric acid is greater. More than about 5% of the inorganic acid is too corrosive to the metal surfaces and unnecessarily adds to the waste volume.

The temperature of the solution should be about 70° to about 200° C. We have found that at lower temperatures, such as room temperature (i.e., 20° to 25° C.), virtually no decontamination occurs. At temperatures above about 200° C., however, the solution is too corrosive to metal surfaces.

The ceric acid solution is circulated through the equipment until the radioactivity level in the solution stabilizes. That is, the solution is circulated until the radioactivity of the solution leaving the equipment is not substantially greater than the radioactivity of the solution entering the equipment. The equipment is then drained and rinsed, preferably with deionized water at about 70° to about 200° C.

While the ceric acid solution by itself removes at least 97% of the radioactivity, removal of some of the additional remaining radioactivity can be accomplished by using a conventional decontamination solution after using the ceric acid solution. A conventional decontamination solution is a mixture of a chelate such as ethylenediaminetetraacetic acid or nitrilotriacetic acid with an organic acid such as citric or oxalic acid. The conventional decontamination solution is circulated at 70° to about 200° C. between the equipment and a cation exchange column until the radioactivity of the solution leaving the equipment is not substantially greater than the radioactivity of the solution entering the equipment. The equipment is then rinsed with deionized water and its decontamination is complete. The spent ceric acid solution can be cleaned using a mixed anion-cation exchange resin or it can be neutralized with hydroxide and evaporated and disposed of as solid waste. The spent decontamination solution can be cleaned with an anion exchange resin or a mixed exchange resin.

Depletion of the cerium IV in the solution can be avoided by oxidation of cerium III to cerium IV before it is recirculated to the contaminated equipment. Oxidation can be accomplished, for example, by the addition of an oxidizing agent, such as ozone or a peroxide, to the solution, or by electrolysis of the solution. The use of ozone is preferred because it has the highest oxidation potential, is the most reactive oxidant, and is easy to add to the solution. The addition of ozone to the solution is preferably accomplished by bubbling it into the solution (sparging), but ozone can also be formed in place electrically using a membrane. (The electrolysis used to form ozone can also be used instead of a cation exchange column to remove transition metals and other metals.)

After the cerium III has been oxidized to cerium IV it is advantageous to pass the solution through a hydrogen form cation exchange resin. The cation exchange resin removes radioactive metal ions that do not complex with the cerium IV acid solution, such as iron, cobalt, and nickel. The oxidation of cerium III to cerium IV must be performed before the solution passes through the cation exchange column, because cerium III does not form a strong anionic complex and will be removed onto the column. Cerium IV, however, forms a strong anionic complex with the inorganic acid and will pass through the column. The cation exchange column must be in the hydrogen form (i.e., give off hydronium ions) and is preferably a strong acid, such as sulfonic acid, or a chelating type resin. The removal of metal ions onto the column frees up the cerium complex to remove additional metal ions from the contaminated equipment.

Since the uranyl and plutonyl ions (believed to be $UO_2^{+2}$ and $PuO_2^{+2}$, respectively) form anionic complexes with the inorganic acid anion, uranium and plutonium will also pass through the column. They can then be recovered from the solution, either continuously before it is recirculated to the contaminated equipment, or after decontamination of the equipment is completed. Recovery of the uranium and plutonium can be accomplished by methods well-known in the art. These include extraction into an extractant-containing organic solvent such as tributyl phosphate in decane or DEPA-TOPA (di (2-ethylhexyl) phosphoric acid - tri (n-octyl) phosphine oxide) in kerosene. Uranium and plutonium can also be removed using an anionic exchange column (chromatography separation). While extraction can be performed prior to passing the aqueous solution through the cation exchange column, it is preferably performed afterwards because fewer metal ions and less radiation, particularly gamma radiation, is present.

The following examples further illustrate this invention.

EXAMPLE 1

Samples of tubes from the steam generator of a pressurized water nuclear reactor about 1% inches long and ¾ inches in diameter were cut in half longitudinally. The samples were placed in beakers containing various decontamination solutions (except in some experiments the solutions were circulated over the samples in the beakers). After each sample was treated with a decontamination solution, the decontamination factor was determined. (The decontamination factor (DF) is the radioactivity in microcuries before treatment divided by the radioactivity in microcuries after treatment.) The following table gives the sequence of treatment of eleven different samples treated with various decontamination solutions for different times and temperatures. In the table, "CM" is a commercial decontaminating solution believed to be 30% citric acid, 30% oxalic acid, 40% ethylenediaminetetraacetic acid, and containing an inhibitor believed to be thiourea. "CAS" is ceric ammonium sulphate, "CAN" is ceric ammonium nitrate, and "TSCA" is tetrasulfato ceric acid.

The above table shows that ceric ammonium nitrate is not effective in decontaminating the samples. It also shows that tetrasulfato ceric acid is very effective at higher concentrations, but is ineffective at concentrations of 0.25% or less.

EXAMPLE 2

Example 1 was repeated. The following table gives the results:

| Treatment Sequence | | Step DF | | Final | |
|---|---|---|---|---|---|
| Step 1 | Step 2 | 1 | 2 | DF | Comments |
| 1% $H_2SO_4$ 6 hrs, 95C | .5% CM 6 hrs, 95C | — | 1.04 | 1.04 | Ineffective |
| .5% TSCA, 1% $H_2SO_4$ 6 hrs, 100C | .5% CM 4 hrs, 100C | 33.81 | 1.10 | 37.17 | ID still covered by oxide layer, effective |
| .5% CAN, 1% $HNO_3$, 6 hrs, 100C | " | 1.03 | 1.26 | 1.29 | Ineffective |
| 5% $H_2SO_4$ 6 hrs, 22C | | 1.01 | | 1.01 | Ineffective |
| 1% TSCA, 5% $H_2SO_4$ 6 hrs, 20C no mixing | 1% TSCA, 5% $H_2SO_4$ 6 hrs, 100C no mixing | 1.01 | 326.6 | 329.5 | ID still covered by oxide very effective |
| 5% $H_2SO_4$ 6 hrs, 100C no mixing | | 49.47 | | 49.47 | Oxide layer still present many cracks |

The above table shows that 1% sulfuric acid by itself was ineffective and 5% sulfuric acid was ineffective at 22° C., but effective at 100° C., albeit with considerable corrosion. (The "100° C." temperature was actually the highest possible temperature that could be obtained without boiling the solution.) The table also shows that the ceric ammonium nitrate-nitric acid solution did not effectively decontaminate the samples. The tetrasulfato ceric acid in combination with sulfuric acid was also ineffective at 20° C., but was extremely successful at 100° C., and much more effective at a concentration of 5 to 6% than was sulfuric acid alone.

I claim:

| Treatment Sequence | | | | | Step DF | | | | | Final |
|---|---|---|---|---|---|---|---|---|---|---|
| 1 | 2 | 3 | 4 | 5 | 1 | 2 | 3 | 4 | 5 | DF |
| .5% CM 4 hrs, 100C | .1% $K_2FeO_4$ 4 hrs 40C, pH10 | .5% CM, 4 hrs, 100° C. | .5% TSCA, 1% $H_2SO_4$ 6 hrs, 100C | .5% CM 4 hrs, 100C | 1.06 | 1.00 | 1.10 | 143.06 | 1.81 | 300.40 |
| .5% CM 24 hrs, 100C | .1% $K_2FeO_4$, 4 hrs, 48C | .5% CM 23 hrs, 95° C. | .1% CAS, 4 hrs, 100C, pH 2.6 | .5% CM 10 hrs, 100C | — | — | 1.05 | — | 1.00 | 1.05 |
| " | " | " | .1% CAS, 6 hrs, 100C, pH 2.6 | .5% CM 12 hrs, 100C | — | — | 1.05 | — | 1.00 | 1.05 |
| .5% CM 4 hrs, 100C | .5% CAS, 6 hrs, 100C | .5% CM 4 hrs, 100C | | | 1.10 | .94 | 1.01 | | | 1.05 |
| " | " | .5% CM 4 hrs, 121° C. | | | 1.01 | 1.08 | .89 | | | .97 |
| " | .1% CAS, 6 hrs, 100C | .1% CAN, .4% $HNO_3$ 7.5 hrs, 100C | .5% CM 4 hrs, 100C | | 1.11 | .95 | 1.34 | .88 | | 1.24 |
| " | .1% TSCA, .3% $H_2SO_4$ 7.5 hrs, 100° C. | .5% C 4 hrs, 100° C. | | | 1.03 | 1.03 | 1.03 | | | 1.09 |
| " | .25% TSCA .75% $H_2SO_4$ 6 hrs, 100C | .5% C 4 hrs, 100° C. | .5% TSCA 1% $H_2SO_4$ 6 hrs, 100C | .5% CM 4 hrs, 100C | 1.05 | 1.22 | 1.03 | 60.60 | .97 | 77.83 |
| " | .25% CAN, .75% $HNO_3$ 6 hrs, 100C | " | | | 1.03 | 1.02 | 1.00 | | | 1.05 |
| " | .5% CAN, 1% $HNO_3$ 6 hrs, 100C | " | | | 1.07 | 1.11 | .94 | | | 1.11 |
| " | .5% CAN, 1% $HNO_3$ 6 hrs, 70C | " | | | 1.06 | 1.13 | 1.02 | | | 1.23 |

1. A composition consisting of (A) water;

(B) about 0.5 to about 3% by weight of a ceric acid selected from the group consisting of tetrasulfato ceric acid, hexasulfamato ceric acid, hexaperchlorato ceric acid, and mixtures thereof; and (C) and about 1 to about 5% by weight of an inorganic acid, where said inorganic acid is sulfuric acid when said ceric acid is tetrasulfato ceric acid, sulfamic acid when said ceric acid is hexasulfamato ceric acid, perchloric acid when said ceric acid is hexaperchlorato ceric acid, and a corresponding mixture selected from the group consisting of sulfuric acid, sulfamic acid, and perchloric acid when said ceric acid is a mixture selected from the group consisting of tetrasulfato ceric acid, hexasulfamato ceric acid, and hexaperchlorato ceric acid.

2. A composition according to claim 1 wherein said ceric acid is tetrasulfato ceric acid.

3. A composition according to claim 1 which includes ozone.

* * * * *